United States Patent [19]

Law

[11] Patent Number: 5,074,239

[45] Date of Patent: Dec. 24, 1991

[54] EASTER EGGS DECORATING AND COLORING KIT

[76] Inventor: Verlene Law, 2220 NW. 124th St., Miami, Fla. 33167

[21] Appl. No.: 663,570

[22] Filed: Mar. 4, 1991

[51] Int. Cl.[5] ..... B05C 13/02

[52] U.S. Cl. ..... 118/429; 118/26; 206/1.8; 206/575; 220/23.8; D19/36; 426/250

[58] Field of Search ..... 426/250, 249, 308, 303, 426/302; 118/26, 27, 30, 31, 13, 429, 503, 505, 506; D19/35, 36; D9/341, 329; D7/611; 206/1.7-1.9, 575, 214, 224; 220/23.8

[56] References Cited

U.S. PATENT DOCUMENTS

| | | | |
|---|---|---|---|
| D. 264,350 | 5/1982 | Jacobsen | D19/35 |
| 1,193,181 | 8/1916 | Peck | 206/1.7 |
| 1,538,367 | 5/1925 | Young | 426/250 |
| 1,829,645 | 10/1931 | Gibbens | 8/483 |
| 1,829,689 | 10/1931 | Townley et al. | 426/250 |
| 1,952,612 | 3/1934 | Sherwood | 8/483 |
| 1,982,820 | 12/1934 | Lowenstein | 426/250 |
| 2,074,376 | 3/1937 | Dorcey | 426/250 |
| 2,165,345 | 7/1939 | Conway et al. | 206/1.8 |
| 2,593,566 | 1/1949 | Kamp | 426/250 |
| 3,491,875 | 1/1970 | Fischer et al. | 206/1.7 |
| 3,581,882 | 6/1971 | Bish | 206/1.7 |
| 3,745,973 | 7/1973 | Knecht | 426/250 |
| 3,840,113 | 10/1974 | Bartleson | 206/1.7 |
| 3,848,564 | 11/1974 | Kull | 118/13 |
| 4,181,745 | 1/1980 | Growe et al. | 426/250 |
| 4,370,941 | 2/1983 | Belton | 118/13 |
| 4,371,558 | 2/1983 | Tully | 426/250 |
| 4,419,103 | 12/1983 | Balkan | 426/250 |
| 4,531,475 | 7/1985 | Thill | 118/13 |
| 4,599,235 | 7/1986 | Miller et al. | 426/250 |
| 4,664,925 | 5/1987 | McShane | 426/250 |
| 4,693,205 | 9/1987 | Thill | 118/13 |
| 4,798,162 | 1/1989 | Nelson | 118/26 |
| 4,853,240 | 8/1989 | McShane | 426/250 |
| 4,967,687 | 11/1990 | McShane | 118/26 |

*Primary Examiner*—Steven Weinstein

*Attorney, Agent, or Firm*—Malloy, Downey & Malloy

[57] ABSTRACT

An Easter egg decorating and coloring kit for dyeing and painting Easter eggs and including an arrangement of dye chambers integrally formed and arranged in a linear orientation. A paint tray having paint receptacles and a paintbrush receptacle for placement of a paintbrush therein is integrally formed with and extends outwardly from a rear top edge of the dye chambers. A ladle for placement and removal of the Easter eggs from within the dye chambers is removably supported on a front of the dye chambers and includes an envelope attached to a head portion thereof containing dye tablets of a variety of colors to be dissolved within the chambers to form a dye solution.

8 Claims, 1 Drawing Sheet

EASTER EGGS DECORATING AND COLORING KIT

BACKGROUND OF THE INVENTION

1. Field of the Invention

An Easter egg decorating and coloring kit for dyeing eggs in various colors and painting designs thereon.

2. Summary of the Related Art

The art of decorating Easter eggs is a well-known annual activity which virtually all children enjoy. Every year, during the Easter season, children and their parents take part in Easter egg decorating wherein ordinary eggs are dyed and sometimes painted in various colors and designs to celebrate the Easter holiday. While most children enjoy decorating the eggs, the process itself is generally quite messy and is often stressful for parents who are left to clean up the mess once the dyeing and painting process is completed. Traditionally, the dyeing process has been accomplished using a series of individual bowls in which a different colored dye mixture is contained in each bowl. Usually, parents will use cereal bowls, or the like, in which one or several eggs are placed for dyeing therein. The bowls generally take up most of the space on the table and spilling of the dye when moving the bowls to make extra work room is a frequently occurring problem.

After dyeing, the eggs are often painted with various designs or children's names to further enhance the eggs overall appearance. The painting process requires a different set of supplies and equipment to be used which is not ordinarily supplied with egg dyeing kits. The additional materials required further congest the working space which inevitably leads to accidents and spills further adding to the mess.

There are several Easter egg decorating kits in the related art which represent an improvement in the egg decorating process over the traditionally known methods. One such decorating kit is disclosed in Thill, U.S. Pat. No. 4,693,205 which includes an apparatus for supporting eggs in a plurality of tubes containing decorating fluid wherein the fluid is dripped onto the egg while held by support legs on the apparatus. The decorating fluid flows over the egg and any excess fluid drips down into a tray portion on the support apparatus.

The patent to Helmer, U.S. Pat. 4,573,586 discloses an Easter egg dyeing and drying device comprising a one-piece rack having an upper portion and a lower portion. The upper portion includes dye wells structured to receive dye cups therein. The lower portion includes egg receiving recesses for placement of eggs therein for drying after dyeing the eggs. A drip trap surrounds the lower portion to catch liquid which may spill out of the cups or off of the eggs while drying.

While the above-mentioned Easter egg decorating kit maybe effective and suitable for their intended purpose, they are somewhat cumbersome and do not include all of the egg decorating and dyeing equipment which is necessary in order to decorate Easter eggs in the traditional fashion.

With the foregoing in mind, it is an object of the present invention to provide an Easter egg decorating and coloring kit which is relatively compact and includes a plurality of dye chambers integrally formed together in a one-piece unit wherein a number of eggs can be simultaneous dyed a variety of colors.

It is another object of the present invention to provide an Easter egg decorating and coloring kit which further includes painting equipment so that the eggs can be painted with designs either before or after dyeing.

It is yet another object of the present invention to provide an Easter egg decorating and coloring kit which includes all of the necessary materials in order to paint and dye Easter eggs while using a relatively small amount of work space, and thus reducing the overall mess which is generally created when coloring and decorating Easter eggs.

It is a further object of the present invention to provide an Easter egg decorating and coloring kit which is relatively simple to use and inexpensive to manufacture.

These and other objects and advantages of the present invention will be more readily apparent in the description which follows.

SUMMARY OF THE INVENTION

The present invention is directed to an Easter egg decorating and coloring kit for dyeing and painting Easter eggs. A plurality of dye chambers are integrally formed and arranged adjacently in a linear orientation, each of the dye chambers being sized and configured for receipt of a dye solution and an egg to be dyed therein. An inner wall construction of each of the dye chambers is congruently configured with the outer shape of an egg so as to support and position the egg in a substantially upright, spaced relation therein.

A paint tray is integrally formed with the dye chambers and extends outwardly from a rear side thereof along the length of the chambers adjacent open tops thereof. The paint tray includes a plurality of paint containing receptacles and a brush receptacle for placement of a paintbrush therein.

Support hooks extending from a front of the dye chambers releasably support an egg ladle thereon. The egg ladle is designed to facilitate placement and removal of eggs into and out from the chambers and includes a handle portion and a head portion sized and configured to hold an egg therein. An envelope containing dye tablets of various colors is fitted over the head portion for packaging.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature of the present invention, reference should be had to the following detailed description taken in connection with the accompanying drawings, in which.

Like reference numerals refer to like parts throughout the several views of the drawings.

DETAILED DESCRIPTION OF THE PREFERRED EMBODIMENT

Figure 1:
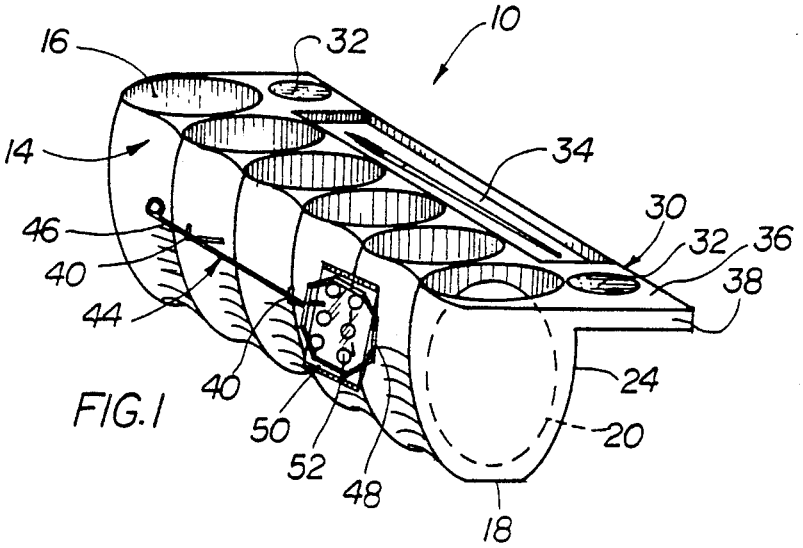
FIG. 1 is a perspective view of the Easter egg decorating and coloring kit of the present invention.

Referring to FIG. 1, there is generally illustrated the Easter egg decorating and coloring kit 10 of the present invention for dyeing and painting Easter eggs in various colors and designs.

The egg decorating and coloring kit 10 includes a plurality (preferably six) of dye chambers 14 integrally formed together and arranged in a linear orientation. Each of the chambers has a substantially curved outer surface tapering slightly from an open top 16 to a flat bottom portion 18. The flat bottoms 18 of each of the dye chambers 14 form a support base adapted to support the entire assembly in a substantially upright position on a substantially flat support surface such as a tabletop. The dye chambers 14 are specifically sized and configured to supportably receive an egg 20 therein, such with that chamber partially filled with a dye solution, the egg will be completely submerged thereby coloring the entire egg.

Integrally formed with an extending from a rear side 24 of the arrangement of dye chambers 14 is a paint tray 30 having a plurality of paint receptacles 32 and a paintbrush receptacle 34 formed in a top surface 36 thereof. A flange lip portion 38 surrounds the sides and back of the paint tray 30 to enhance the overall appearance thereof.

Supported by a pair of hooks 40 on the front of the chambers 14 there is an egg ladle 44 specifically designed to facilitate placement and removal of an egg 20 into and out from a submerged position within a dye chamber 14. The egg ladle 44 includes a stem 46 forming a handle thereof and a head portion 48 having a multi-sided configuration with an aperture therein, specifically sized and dimensioned to hold and support an egg for placement and removal from within the chambers 14. For packaging purposes, an envelope 50 is attached to the head portion 48 in covering relation thereto. The envelope contains a plurality of dye tablets 52 of various colors. The dye tablets 52 are adapted to be resolved in water filled within the dye chambers 14, thereby forming a dye solution for coloring the eggs. The envelope 50 is preferably formed of a cellophane or similar type transparent material such that the dye tablets 52 therein are readily visible.

Figure 2:
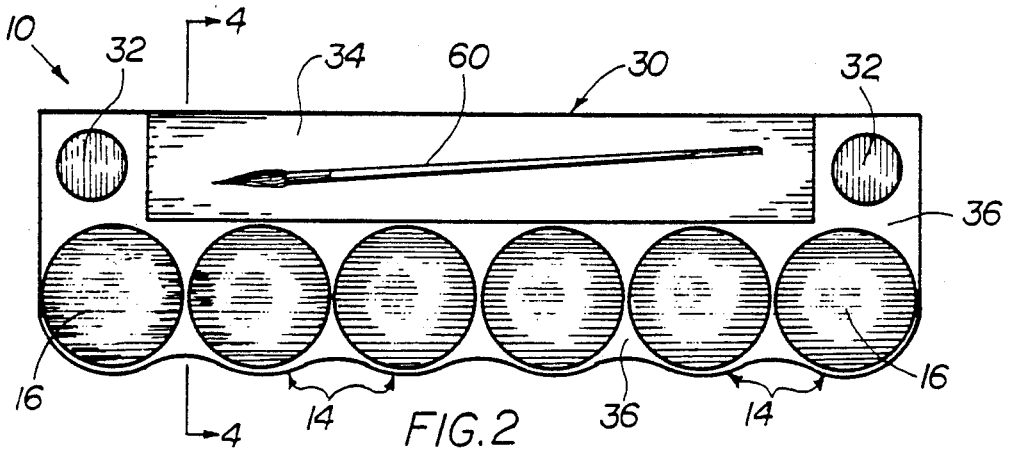
FIG. 2 is a top plan view of the integrally formed dye chambers and paint tray of the present invention.
Figure 4:
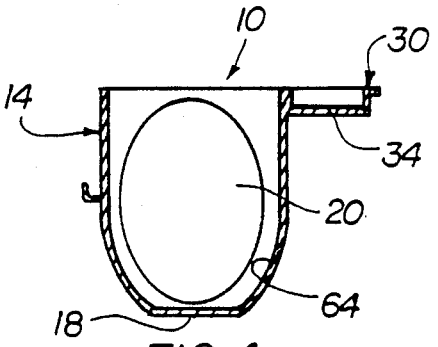
FIG. 4 is a sectional view taken along line 4—4 of FIG. 2.

Referring to FIG. 2, the arrangement of dye chambers 14, paint receptacles 32 and the brush receptacle 34 is seen. Each of the paint receptacles 32 are recessed within the top surface 36 of the tray 30 and contain a charge of paint therein, each receptacle having a different color. While the preferred embodiment includes two paint receptacles 32, additional paint receptacles can be included and arranged in a suitable manner over the top surface 36 of the paint tray 30. The brush tray 34 is recessed within the top surface 36 of the paint tray, as best illustrated in FIGS. 1 and 4 and is generally sized and dimensioned to allow placement of a standard paintbrush 60 therein. As seen in FIG. 2, the top surface 36 of the paint tray is integrally formed with and surrounds each of the dye chambers 14.

Figure 3:
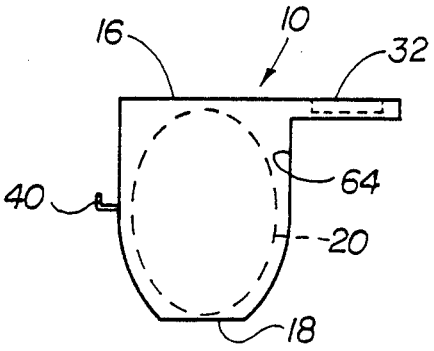
FIG. 3 is a side elevation of the integrally formed dye chambers and paint tray illustrating an egg contained in one of the chambers and a paint receptacle within the paint tray.

As best illustrated in FIGS. 3 and 4, an interior wall construction 64 of each of the dye chambers 14 is congruently dimensioned and configured so as to substantially conform with the outer configuration of an egg such that an egg 20 placed in the dye chambers 14 is supported in a substantially upright position in spaced relation to the interior walls 64. In this manner, a dye solution within the dye chambers 14 will substantially surround the egg 20 submerged therein so that the entire egg will be colored.

Now that the invention has been described, what is claimed is:

1. An Easter egg decorating and coloring kit, comprising:

a plurality of dye chambers each sized and configured for receipt of an egg to be colored therein, wherein each of said dye chambers are adapted to be at least partially filled with a dye solution such that an egg placed within the dye chamber will be completely submerged, said plurality of dye chambers integrally formed in adjacent, substantially linear orientation relative to one another, each of said plurality of dye chambers includes an open top having a diameter greater than a diameter of the egg to be placed therein, and a substantially flat bottom defining a support base adapted to support said dye chambers in an upright position on a supporting surface, a paint tray integrally formed along and extending outwardly from a rear top edge of said dye chambers adjacent said open top thereof, said paint tray including a plurality of paint receptacles containing paint therein, and a paintbrush receptacle for placement of a paintbrush therein, a paintbrush sized and configured to be placed and supported within in said paintbrush receptacle, an egg ladle removably secured and supported to a front of said dye chambers and including a head portion, said egg ladle being structured and configured to facilitate placement and removal of an egg into and out from within said dye chambers, and package means fitted to said head portion of said ladle and containing a plurality of dye tablets therein.

2. A kit as in claim 1 wherein each of said dye chambers include a substantially curved outer surface tapering in diameter from said open top to said bottom.

3. The kit as in claim 2 wherein each of said dye chambers includes an inner wall construction having a configuration congruent to an egg shape for placement and substantial support of an egg in spaced relation therein.

4. A kit as in claim 3 wherein said paint receptacles are recessed within said paint trays so as to be flushed with a top surface thereof.

5. A kit as in claim 4 wherein said egg ladle includes a stem extending from said head portion, said stem defining a handle portion.

6. A kit as in claim 5 wherein said head portion of said ladle includes a multi-sided aperture sized and configured to support an egg therein.

7. A kit as in claim 6 wherein said package means includes an envelope having two oppositely disposed panels connected about correspondingly positioned outer edges in surrounding relation to an envelope interior containing said plurality of dye tablets.

8. A kit as in claim 7 wherein said front of said dye chambers includes support hooks extending outwardly therefrom for removable support of said egg ladle thereon.

* * * * *